US007169264B2

(12) United States Patent
Bartelmuss

(10) Patent No.: US 7,169,264 B2
(45) Date of Patent: Jan. 30, 2007

(54) WIRE FOIL FOR A PAPER PRODUCTION INSTALLATION

(76) Inventor: Klaus Bartelmuss, Nr. 63, A-8833 Teufenbach (AT)

( * ) Notice: Subject to any disclaimer, the term of this patent is extended or adjusted under 35 U.S.C. 154(b) by 561 days.

(21) Appl. No.: 10/611,083

(22) Filed: Jul. 1, 2003

(65) Prior Publication Data

US 2004/0050521 A1 Mar. 18, 2004

(30) Foreign Application Priority Data

Sep. 12, 2002 (AT) ..... A 1363/2002
Oct. 24, 2002 (AT) ..... A 1614/2002

(51) Int. Cl.
*D21G 9/00* (2006.01)
*D21F 1/20* (2006.01)
*D21F 1/48* (2006.01)

(52) U.S. Cl. ..... 162/352; 162/351; 162/354; 162/374

(58) Field of Classification Search ..... 162/199, 162/274, 209, 211, 351, 325, 363, 374, 272, 162/256, 257, 354–356, 352, 371
See application file for complete search history.

(56) References Cited

U.S. PATENT DOCUMENTS 3,870,597 A * 3/1975 Getman et al. ..... 162/352
3,928,125 A * 12/1975 Poeschl ..... 162/352
4,280,869 A * 7/1981 Eckerdt ..... 162/252
5,630,910 A * 5/1997 McPherson ..... 162/352

* cited by examiner

*Primary Examiner*—Eric Hug
(74) *Attorney, Agent, or Firm*—Laurence A. Greenberg; Werner H. Stemer; Ralph E. Locher

(57) ABSTRACT

A wire foil for a paper production installation has a supporting strip and plates fixed to the latter. The plates are mutually adjoining ceramic plates. The supporting strip and the plates of ceramic material are formed, on the mutually contacting surfaces, with mutually facing recesses, in which connecting elements are anchored. The connecting elements are fixed in the recesses in the plates of ceramic material by a form fit, and plates located beside one another are fixed to the supporting strip by at least one common connecting element extending over the joint.

14 Claims, 7 Drawing Sheets

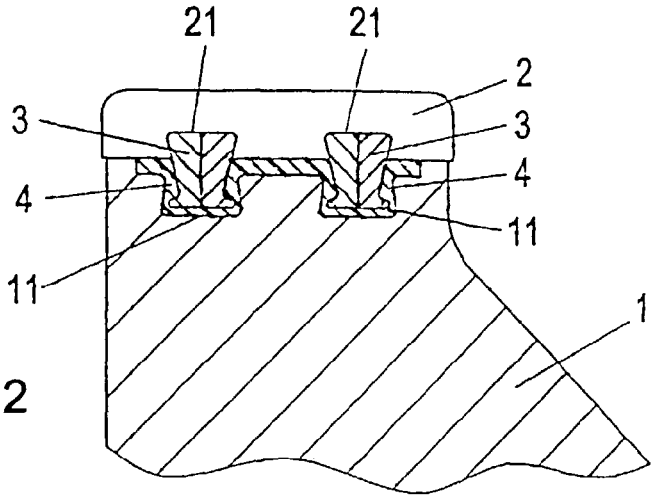
FIG. 2
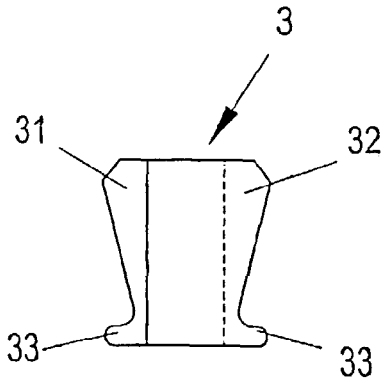
FIG. 2A
FIG. 2B
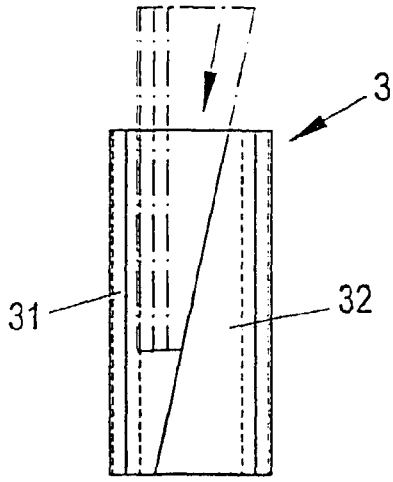
FIG. 2C
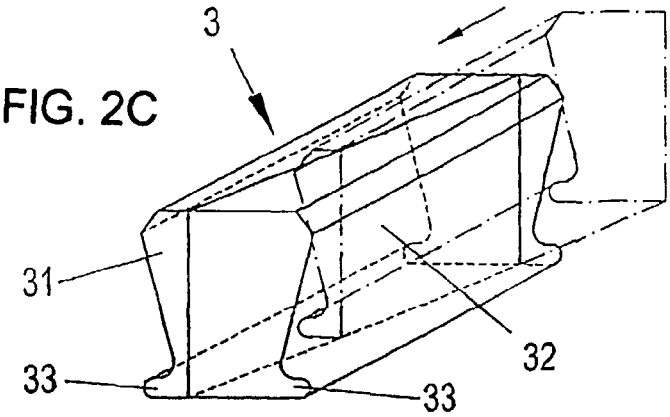

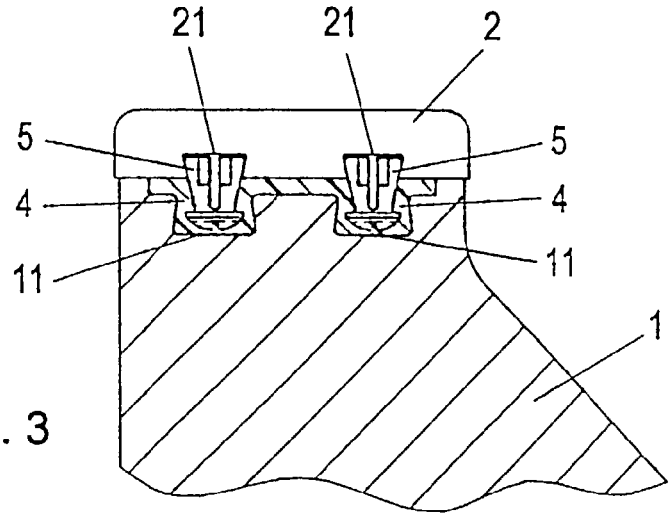
FIG. 3
FIG. 3A
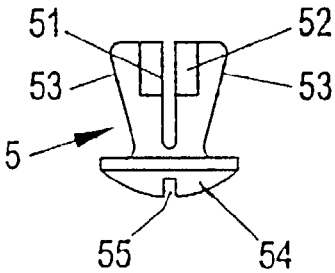
FIG. 3B
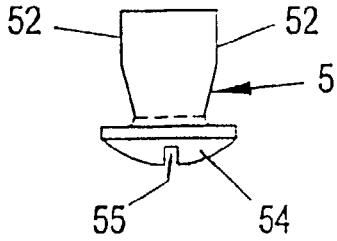
FIG. 3C
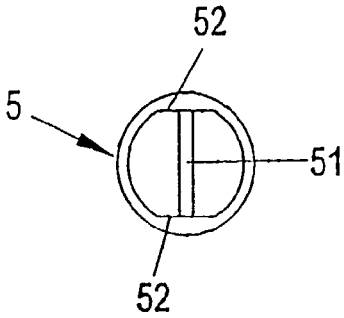
FIG. 3D
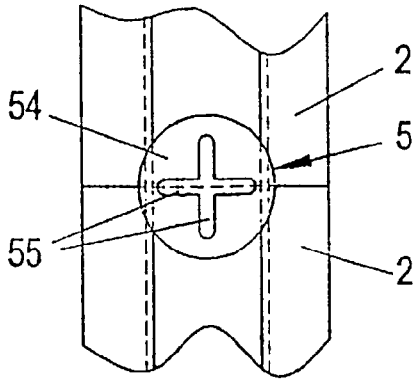

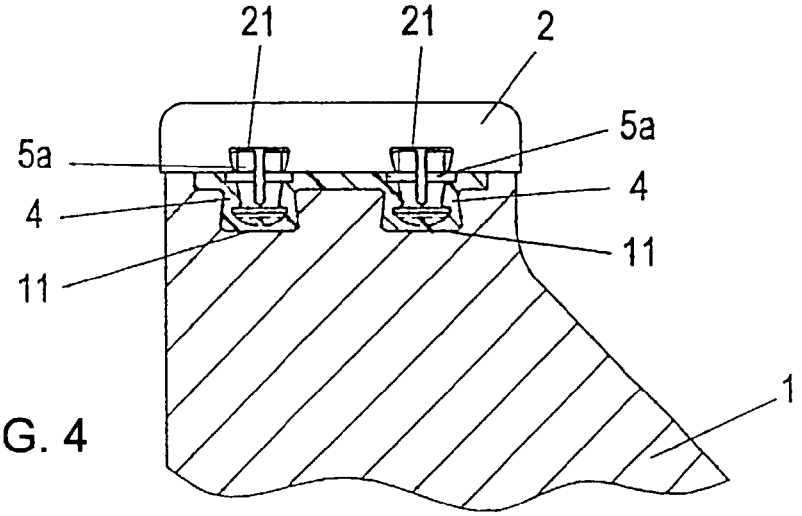
FIG. 4
FIG. 4A
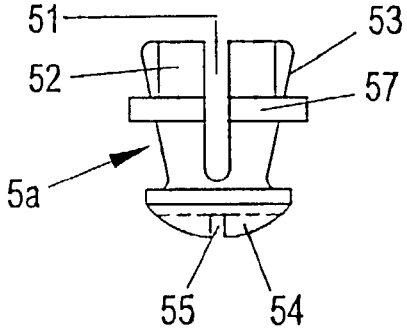
FIG. 4B
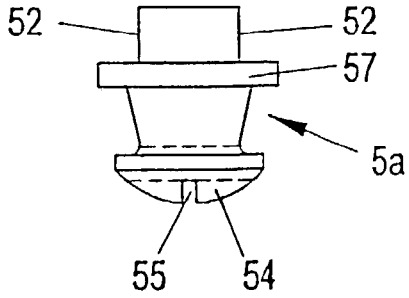
FIG. 4C
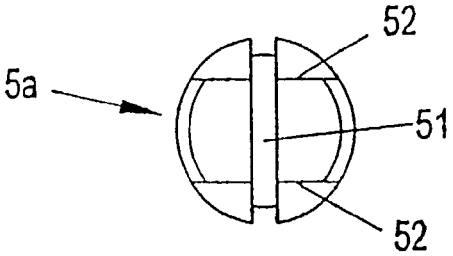
FIG. 4D
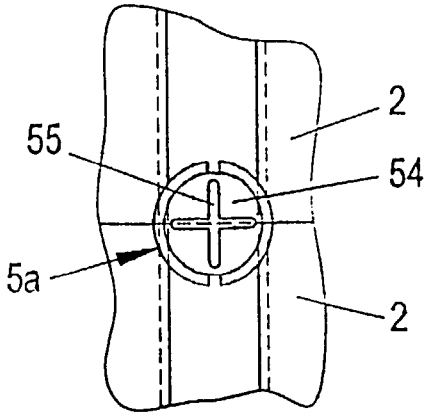

WIRE FOIL FOR A PAPER PRODUCTION INSTALLATION

BACKGROUND OF THE INVENTION

Field of the Invention

The present invention relates to a wire foil in a paper making machine of a paper production installation. The wire foil has a supporting strip and plates fixed to the latter, adjoining one another and made of a ceramic material. The supporting strip and the plates of ceramic material are formed on the mutually contacting surfaces with mutually facing recesses, in which connecting elements are anchored.

Installations for paper production have a wire or screen, to whose top side a dilute paper slurry with the paper stock is applied. The liquid contained in the paper stock passes through the wire, being wiped off by wire foils, over which the wire is guided. Since wire foils of this type are subjected to high mechanical loadings and, furthermore, the liquid emerging from the paper stock is extremely aggressive, the wire foils must consist of very resistive materials. For this reason, wire foils are provided with plates of ceramic materials.

Plates consisting of ceramic materials, which are produced by powder sintering, however, can be produced only in lengths from about 10 cm to 20 cm (4–8 inches). Since, by contrast, wires in paper production installations have widths of more than 6 m (~20 ft.), this means that the wire foils are constructed with a large number of ceramic plates arranged close to one another, which are fixed individually to a supporting strip.

In order to fix the plates of ceramic material to the supporting strips, it has been known to form both the supporting strips and the plates of ceramic material with recesses on the mutually facing surfaces. Connecting elements are anchored in the recesses by way of plastic compounds. The use of plastic compounds for anchoring the connecting elements is, however, disadvantageous inasmuch as these compounds have substantially higher expansion coefficients than the plates of ceramic material, as a result of which, because of thermal expansions, the plates of ceramic material are not fixed to the supporting strips with the required rigidity, but instead, they can execute positional changes with respect to the supporting strips and with respect to one another. This applies in particular with regard to the mutual vertical positions of the individual plates of ceramic material. However, since the wire rests on the wire foils closely under high pressure, a number of disadvantageous effects occur in the event that the surfaces of the wire foils are not completely flat. For example, in regions of increased height of the wire foils, the wire is overloaded, as a result of which the latter is subjected to greatly increased wear. Furthermore, in the regions located beside the regions of increased height, the wire foils rest less closely against the wire, as a result of which their wiping action is reduced, for which reason the paper quality is different over the width of the wire.

SUMMARY OF THE INVENTION

It is accordingly an object of the invention to provide a wire foil for a paper-making machine, which overcomes the above-mentioned disadvantages of the heretofore-known devices and methods of this general type.

With the foregoing and other objects in view there is provided, in accordance with the invention, a wire foil for a paper-producing machine, comprising:

an elongated supporting strip;

a plurality of abutting plates of ceramic material disposed on the supporting strip;

the supporting strip and the plates having contacting surfaces formed with mutually facing recesses;

connecting elements anchored in the recesses of the supporting strip and the plates;

wherein the connecting elements are fixed in the recesses formed in the plates by a form fit, mutually adjoining plates are fixed to the supporting strip by at least one common connecting element, and the common connecting element extends across a joint formed between the adjoining plates.

In other words, the objects of the invention are achieved, in that the connecting elements are fixed in the recesses in the plates of ceramic material by a form fit, and in that plates located beside one another are fixed to the supporting strip by means of at least one common connecting element which extends over the joint.

The term form fit or form lock is defined as follows: A form-locking connection, or form fit, is one that connects two elements together due to the shape of the elements themselves, as opposed to a friction lock or force lock, which locks the elements together by force external to the elements.

The recesses located in the plates are preferably formed with undercuts, behind which the connecting elements engage. In particular, the recesses provided in the plates are formed by at least one groove extending in the longitudinal direction of the supporting strip.

Each connecting element is preferably formed by a strip which, in the region associated with a recess in the plates, has a cross section that is equal and opposite to the cross section of the recess. In this case, the strip-like connecting element can be subdivided in its longitudinal direction into at least two wedge-like element pieces. In addition, each connecting element can be formed as a conical body which, in the region associated with a recess in a plate, is formed with diametrically arranged flats, it being possible for it to be additionally formed with a slit running transversely with respect to the flats. In addition, each connecting element can be formed with an annularly circumferential collar, which comes to rest on the surface of the plate. Furthermore, each connecting element is preferably formed with an actuating slot or the like on the end face associated with the supporting strip.

According to a further embodiment, the connecting element is formed as a trapezoidal spring body, which can be deformed elastically in its region associated with a recess in a plate. Furthermore, each connecting element can be formed as a cone-like body which, in its part facing the plate, is of slit design and which is provided with an axial hole into which a screw can be screwed, as a result of which the two parts separated by a slit can be adjusted radially away from each other.

According to a further preferred embodiment, the connecting element is formed by a clip, which is formed by two semi-annular clip parts separated by a slot, the grooves provided in the plates having an approximately circular cross section. In this case, the clip parts located in the grooves in the plates are preferably fixed in position by means of a potting compound.

Other features which are considered as characteristic for the invention are set forth in the appended claims.

Although the invention is illustrated and described herein as embodied in a wire foil for a paper production installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a vertical section through a wire foil according to the invention with a first embodiment of a connecting element;

FIG. 2A is a front view of the connecting element of FIG. 2;

FIG. 2B is a plan view thereof;

FIG. 2C is an axonometric illustration thereof;

FIG. 3 is a vertical section through a wire foil according to the invention with a second embodiment of a connecting element;

FIGS. 3A and 3B are two side view of the connecting element according to FIG. 3;

FIGS. 3C and 3D are two plan views thereof;

FIG. 4 is a vertical section through a wire foil according to the invention with a third embodiment of a connecting element;

FIGS. 4A and 4B are two side view of the connecting element according to FIG. 4;

FIGS. 4C and 4D are two plan views thereof;

DESCRIPTION OF THE PREFERRED EMBODIMENTS

Figure 1:
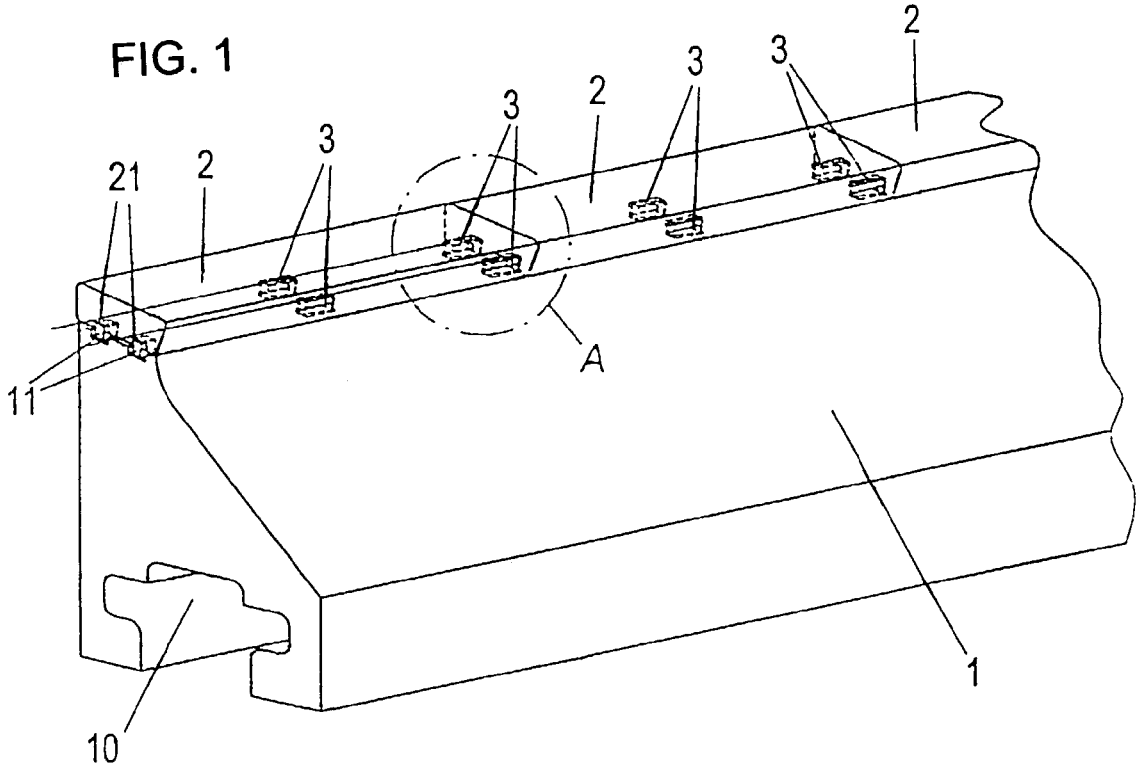
FIG. 1 is an axonometric view of a wire foil according to the invention.
Figure 1A:
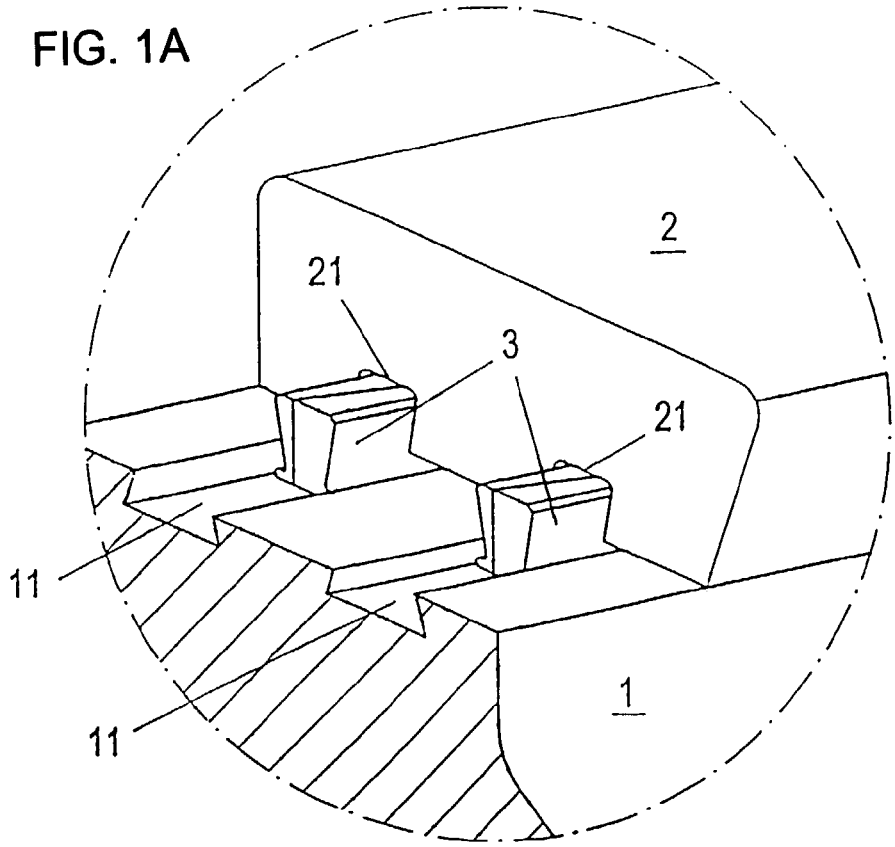
FIG. 1A is a detail A from FIG. 1, on an enlarged scale with respect to FIG. 1.

Referring now to the figures of the drawing in detail and first, particularly, to FIGS. 1 and 1A thereof, the wire foil for paper production installations comprises a supporting strip 1 with an upper side to which plates 2 of ceramic material are fixed over its entire length. On the underside, the supporting strip 1 is formed over its entire length with a groove 10, by means of which it can be fixed to a supporting frame and can be displaced with respect to the latter transversely with respect to the direction of movement of the wire of the paper production installation. On its upper side, the supporting strip 1 is formed with two grooves 11 likewise extending over its entire length. In the same way, the plates 2 of ceramic material are also formed on their underside with grooves 21 extending over their entire length. The grooves 11 and 21 are used to hold fixing elements 3 for fixing the plates 2 of ceramic material to the supporting strip 1.

The connecting elements 3 are arranged in such a way that they extend across the joint between respective two plates 2 of ceramic material located beside each other.

The supporting strip 1 and the connecting elements 3 are produced from steel, from a hard plastic material, such as polyethylene, from glass-fiber-reinforced plastic, from carbon fibers, or similar materials. The material selection for the supporting strips and the connecting elements is known from the prior art.

Referring now to FIGS. 2 and 2A to 2C, there is shown a first type of connecting element 3. As can be seen from FIG. 2, the grooves 21 provided in the plates 2 are designed to be undercut. As can further be seen from FIGS. 2A to 2C, each connecting element 3 is formed in its upper region with a broadening, by which means it is matched to the cross section of the grooves 21 in the plates 2. In order to be able to push the connecting elements 3 into the grooves 21 and lock them in the latter, they are subdivided along a vertical plane into two wedge-like components 31 and 32. On their underside, the connecting elements 3 are formed with laterally projecting ribs 33. The connecting elements 3 are fixed in the grooves 21 in the plates 2 by being pushed into the latter from their end faces. Since the upper region of the connecting elements 2 has a cross section equal and opposite to the grooves 21, the connecting elements are fixed rigidly in the grooves 21 by a form fit. The connecting elements 3 are fixed in the grooves 11 of the supporting strips 1 by introducing a potting compound 4 consisting of plastic. Because of the form-fitting connection of the plates 2 to the connecting elements 3, this has the sought-after rigidity. Since, furthermore, the connecting elements 3 extend over the joints located between two plates 2, the plates 2 located beside each other are also rigidly fixed to each other, their joint edges being located at the same height.

FIGS. 3 and 3A to 3D illustrate a second embodiment of the connecting element according to the invention. This connecting element consists of a conically formed pin 5 which, over part of its height, is formed with a slit 51 and with two diametrical flats 52. Furthermore, at its tapered end, it has a convexly curved head 54 with actuating slots 55.

Because of the flats 52, this connecting element 5 can be inserted into the undercut grooves 21 in the plates 2. As a result of its rotation through 90°, its conical faces 53 come into contact with the side walls of the grooves 21 and, because of the elasticity achieved by means of the slit 51, are locked to the latter by a form fit.

As can be seen from FIG. 3D, these connecting elements 5 are also inserted in the region of the joint into two plates 2 located beside each other, by which means the latter are fixed rigidly to each other.

The connecting element 5A illustrated in FIGS. 4, 4A to 4D differs from the pin 5 according to FIGS. 3A to 3D only in the fact that it is formed with an annularly circumferential collar 57, which comes to rest on the underside of the plates 2.

Figure 5:
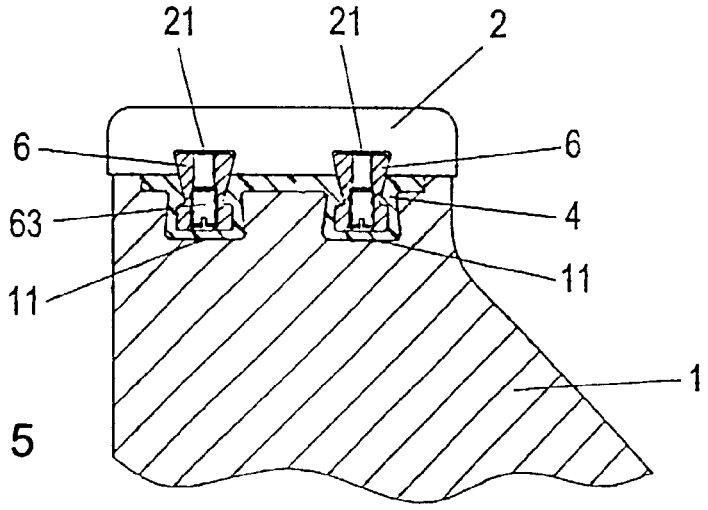
FIG. 5 is a vertical section through a wire foil according to the invention with a fourth embodiment of a connecting element.
Figure 5A:
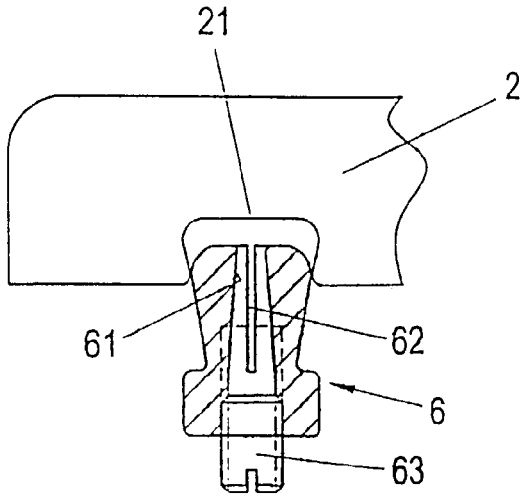
FIGS. 5A and 5B are sectional views of the connecting element according to FIG. 5 in two stages of its use.
Figure 5B:
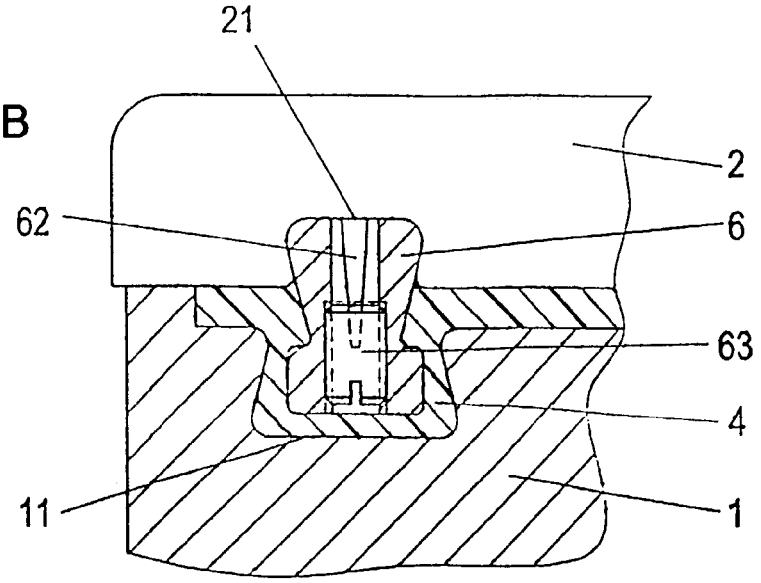

The connecting element illustrated in FIGS. 5, 5A and 5B is likewise formed by a conical pin 6, which is formed with a central hole 61 and with a slit 62, a screw 63 being assigned to the central hole 61. By screwing in the screw 63, the two wings of the pin 6 assigned to the grooves 21 are moved away from each other, as a result of which they are locked in the grooves 21 by a form fit.

Figure 6:
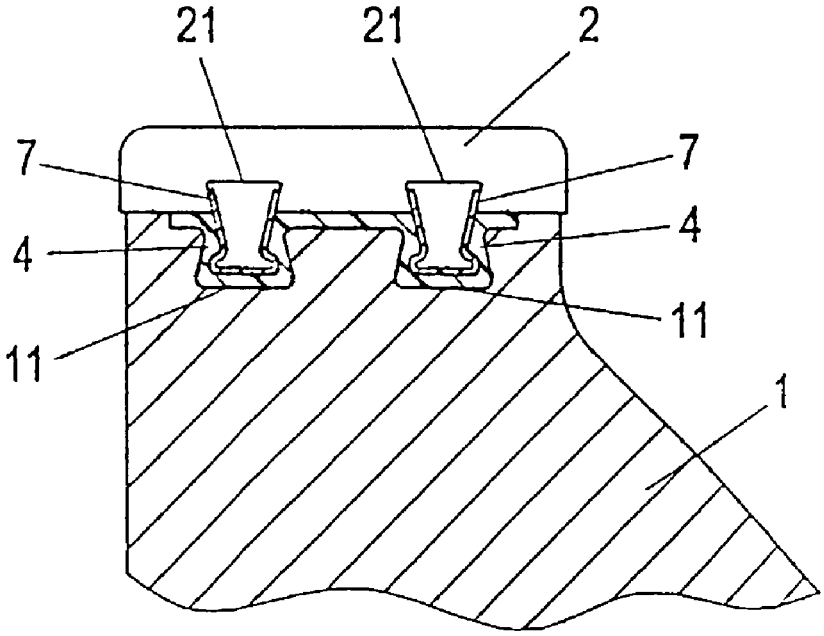
FIG. 6 is a vertical section through a wire foil according to the invention with a fifth embodiment of a connecting element.
Figure 6A:
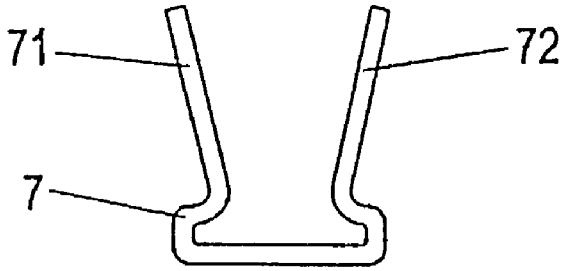
FIG. 6A is a front view of the connecting element of FIG. 6.

The connecting element illustrated in FIGS. 6 and 6A comprises an approximately V-shaped spring 7, whose two legs 72 come to rest with a form fit on the two side walls of the grooves 21.

Figure 7:
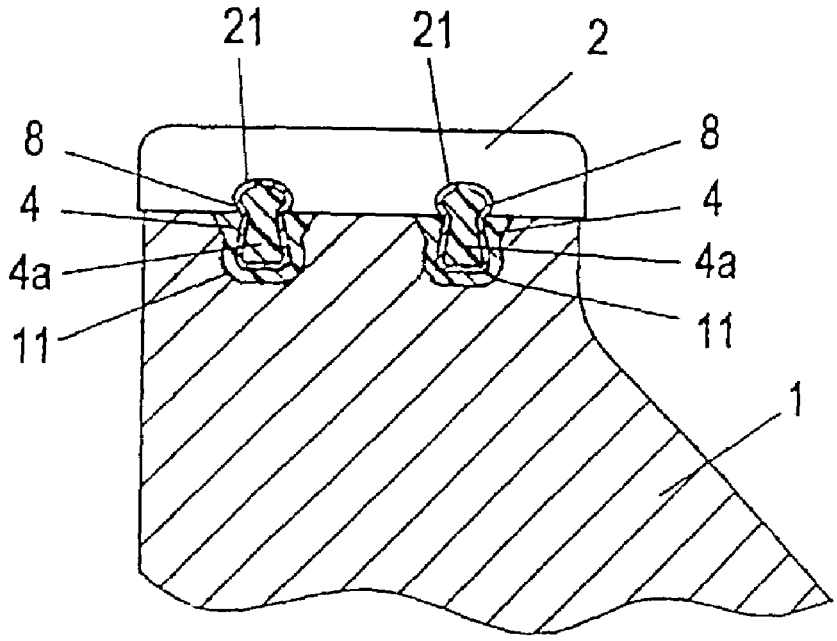
FIG. 7 is a vertical section through a wire foil according to the invention, in a sixth embodiment.
Figure 7A:
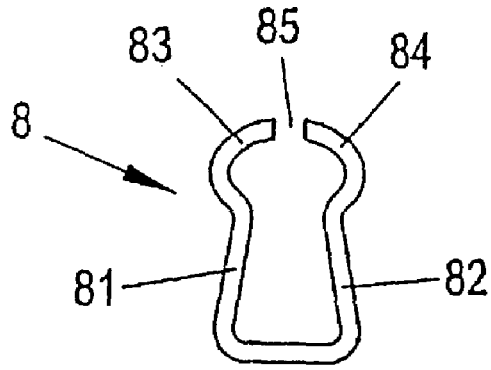
FIG. 7A is a front view of the connecting element of FIG. 7.

The connecting element 8 illustrated in FIGS. 7 and 7A comprises a keyhole-shaped clip 8 which is formed with two legs 81 and 82, which are inserted into the grooves 11 in the supporting strip 1 and are fixed by means of the potting compound 4. The legs 81 and 82 are joined by semi-annular clip parts 83 and 84, which are separated from each other by a slot 85. As a result of the slot 85, the clip 8 has the required elasticity in order to be inserted into the annular grooves 21 in the plates 2. Since the grooves 21 have a corresponding, approximately annular cross section, form-fitting locking of the clips 8 to the plates 2 also takes place here. Finally, the space remaining in the grooves 11 and 21 is filled with a plastic compound 4A, by which means the clips 8 are fixed in position.

These connecting elements also extend beyond the joint between two plates 2, as a result of which the latter are held in their mutual position.

In all the exemplary embodiments, the connecting elements are inserted into the grooves 21 in the plates 2 and rest directly on their side walls, being held in the latter by a form fit. The connecting elements in the grooves of the supporting strips are fixed by means of a casting compound. Furthermore, all the connecting elements are in each case arranged in the region of the joints between two plates 2 of ceramic material, as a result of which, by means of the connecting elements, in each case two plates 2 located beside each other are also rigidly fixed to each other, by which means they are held in the same vertical position.

I claim:

1. A wire foil for a paper-producing machine, comprising:

an elongated supporting strip formed with a recess extending in a longitudinal direction of said supporting strip;

a plurality of plates of ceramic material disposed on said supporting strip and adjoining one another in the longitudinal direction, each of said plates having a recess formed therein extending from an end face thereof, with mutually adjoining said plates forming a continuous recess;

said supporting strip and said plates having contacting surfaces and said recesses of said supporting strip and said plates facing towards one another;

connecting elements disposed to project into and anchored in said recesses of said supporting strip and said plates;

wherein said connecting elements are fixed in said recesses formed in said plates by a form fit and a respective said connecting element projects from the end faces of two mutually adjoining said plates in the continuous recess and fixes the respective said plates to said supporting strip.

2. The wire foil according to claim 1, wherein said recesses in said plates are formed with undercuts, and said connecting elements engage in said undercuts.

3. The wire foil according to claim 1, wherein said recesses in said plates are formed by at least one groove extending in a longitudinal direction of said supporting ship.

4. The wire foil according to claim 1, wherein said connecting elements are strip-shaped elements having a cross section corresponding, in a region associated with said recess in said plates, to a cross section of said recess.

5. The wire foil according to claim 1, wherein said connecting elements are formed as trapezoidal spring bodies, and said spring bodies can be deformed elastically in a region thereof associated with a respective said recess in said plate.

6. A wire foil for a paper-producing machine, comprising:

an elongated supporting strip;

a plurality of plates of ceramic material disposed on said supporting strip and adjoining one another;

said supporting strip and said plates having contacting surfaces formed with mutually facing recesses;

connecting elements anchored in said recesses of said supporting strip and said plates;

wherein said connecting elements are fixed in said recesses formed in said plates by a form fit, mutually adjoining said plates are fixed to said supporting strip by at least one common connecting element, end said common connecting element extends across a joint formed between said adjoining plates;

wherein said connecting elements are strip-shaped elements having a cross section corresponding in a region associated with said recess in said plates to a cross section of said recess; and wherein said strip-shaped connecting elements are subdivided, in a longitudinal direction thereof, into at least two wedge-shaped element pieces.

7. A wire foil for a paper-producing machine, comprising:

an elongated supporting strip;

a plurality of plates of ceramic material disposed on said supporting strip and adjoining one another;

said supporting strip and said plates having contacting surfaces formed with mutually facing recesses;

connecting elements anchored in said recesses of said supporting strip and said plates;

wherein said connecting elements are conical bodies formed, in a region associated with a respective recess in said plate, with diametrically arranged flats, said connecting elements are fixed in said recesses formed in said plates by a form fit, mutually adjoining said plates are fixed to said supporting strip by at least one common connecting element, and said common connecting element extends across a joint formed between said adjoining plates.

8. The wire foil according to claim 7, wherein said connecting elements are formed with respective slits running transversely with respect to said flats.

9. The wire foil according to claim 7, wherein said connecting elements are formed with an annularly circumferential collar, and said collar comes to rest on a surface of said plate.

10. The wire foil according to claim 7, wherein said connecting elements are formed with actuating slots on an end face thereof associated with said supporting strip.

11. A wire foil for a paper-producing machine, comprising:

an elongated supporting strip;

a plurality of plates of ceramic material disposed on said supporting strip and adjoining one another;

said supporting strip and said plates having contacting surfaces formed with mutually facing recesses;

connecting elements anchored in said recesses of said supporting strip and said plates;

wherein one of said connecting elements is a cone-shaped body having a portion facing said plate formed with a slit defining two parts, and said cone-shaped body is formed with an axial bore for receiving a screw, said two parts separated by said slit are adjustable radially apart from each other with the screw, and wherein said connecting elements are fixed in said recesses formed in said plates by a form fit, mutually adjoining said plates are fixed to said supporting strip by at least one common connecting element, and said common connecting element extends across a joint formed between said adjoining plates.

12. A wire foil for a paper-producing machine, comprising:

an elongated supporting strip;

a plurality of plates of ceramic material disposed on said supporting strip and adjoining one another;

said supporting strip and said plates having contacting surfaces formed with mutually facing recesses;

connecting elements anchored in said recesses of said supporting strip and said plates:

wherein said connecting elements are fixed in said recesses formed in said plates by a form fit, mutually adjoining said plates are fixed to said supporting strip by at least one common connecting element, and said common connecting element extends across a joint formed between said adjoining plates; and wherein one of said connecting elements is a clip formed with two semi-annular clip parts separated by a slot formed therebetween.

13. The wire foil according to claim 12, wherein said recesses formed in said plates are grooves with an approximately circular cross section for mating with said semi-annular clip parts.

14. The wire foil according to claim 12, which comprises potting compound fixing said clip parts located in said recesses in said plates in position.

* * * * *